US005199244A

United States Patent [19]

Beier et al.

[11] Patent Number: 5,199,244

[45] Date of Patent: Apr. 6, 1993

[54] PILLOW FILLING APPARATUS

[75] Inventors: Scott B. Beier; Gary L. Pospisal, both of Omaha, Nebr.

[73] Assignee: Products Unlimited, Inc., Omaha, Nebr.

[21] Appl. No.: 491,951

[22] Filed: Mar. 12, 1990

[51] Int. Cl.[5] ..... B65B 1/04; B65B 63/00

[52] U.S. Cl. ..... 53/428; 53/111 R; 53/284.7; 53/469; 53/473; 53/521; 141/67

[58] Field of Search ..... 141/67; 53/111 R, 113, 53/284.7, 266.1, 428, 469, 473, 521, 524

[56] References Cited

U.S. PATENT DOCUMENTS

| | | | |
|---|---|---|---|
| 752,662 | 2/1904 | Ellman et al. . | |
| 1,502,367 | 7/1924 | Baker | 141/67 X |
| 1,573,599 | 2/1926 | Elliott | 53/521 X |
| 2,359,029 | 9/1944 | Goldberg | 141/67 X |
| 2,420,367 | 5/1947 | Geer et al. | 141/67 X |
| 2,574,848 | 11/1951 | Schroeder | 141/67 X |
| 2,794,454 | 6/1957 | Moulthrop | 141/67 |
| 3,693,836 | 9/1972 | Eisner | 141/67 X |
| 3,726,954 | 4/1973 | Munk et al. | 141/67 X |
| 3,878,873 | 4/1975 | Willis et al. | 141/67 |
| 4,664,160 | 5/1987 | Rothstein et al. | 141/67 |

*Primary Examiner*—John Sipos
*Assistant Examiner*—Linda B. Johnson

[57] ABSTRACT

A pillow filling apparatus includes an enclosed housing having an inlet chute for receiving polyester fiber material used as stuffing for the pillow. A pair of pincher rollers feed the fiber material into the housing, and a large fine-toothed roller is mounted adjacent the pinchers such that roller teeth pull and loosen fibers being fed by the pinchers. The large roller rotates at a speed great enough to throw the fibers from the roller into an air chamber. A fan is mounted to one side wall of the housing and produces an air current which is introduced into the air chamber of the housing through an inlet portal and exits the housing through an outlet portal. Fibers thrown by the roller into the air chamber are carried by the air current out of the housing through the outlet portal. A pillow tick is located at the outlet portal of the housing to receive the loosened and fluffed fiber materials.

10 Claims, 4 Drawing Sheets

PILLOW FILLING APPARATUS

TECHNICAL FIELD

The present invention relates generally to apparatus for filling pillows, cushions and the like with stuffing, and more particularly to an improved pillow stuffing apparatus which blows the stuffing into the tick.

BACKGROUND OF THE INVENTION

One of the most basic requirements in pillow stuffing operations, is to prevent the presence of lumps and the like within the pillow after the tick is filled. Prior to the use of apparatus for blowing the stuffing into the tick, such lumps were not a problem.

However, with the advent of methods for blowing stuffing into a tick, the presence of lumps has become a serious problem. Typically, a fan was placed adjacent to the source of stuffing and would draw the fibers into the fan so as to be thrown outwardly and into a tick. Thus, the blades of the fan would mat the fibers and compress them as the forced air carried the fibers into the tick.

It is therefore a general object of the present invention to provide an improved pillow stuffing apparatus.

Another object of the present invention is to provide a pillow stuffing apparatus which fluffs the stuffing material prior to insertion in a tick.

A further object of the present invention is to provide a pillow stuffing apparatus which prevents the lumping or matting of fibers after the fluffing operation has occurred and during the insertion of the stuffing material into a tick.

These and other objects of the present invention will be apparent to those skilled in the art.

SUMMARY OF THE INVENTION

The pillow filling apparatus of the present invention includes an enclosed housing having an inlet chute for receiving material used as stuffing for the pillow. A pair of pincher rollers feed the fiber material through the housing, and a large fine-toothed roller is mounted adjacent the pinchers such that roller teeth pull and loosen fibers being fed by the pinchers. The roller rotates at a speed great enough to throw the fibers from the roller into an air chamber. A fan is mounted to one side wall of the housing and produces an air current which is introduced into the air chamber of the housing through an inlet portal and exits the housing through an outlet portal. Fibers thrown by the roller into the air chamber are carried by the air current out of the housing through the outlet portal. A pillow tick is located at the outlet portal of the housing to receive the loosened and fluffed fiber materials.

DESCRIPTION OF THE PREFERRED EMBODIMENT

Figure 1:
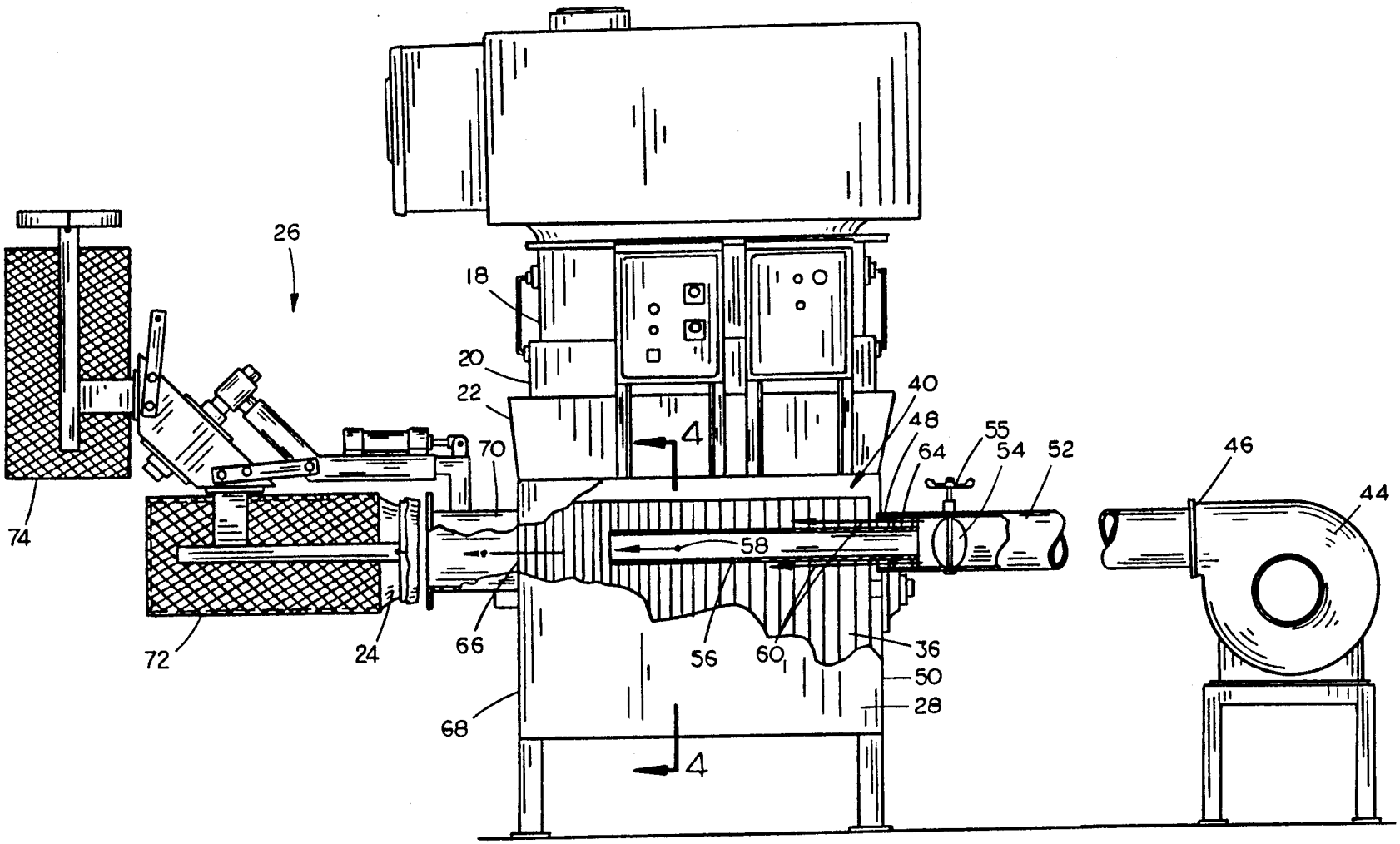
FIG. 1 is a front elevational view of the pillow stuffing apparatus of the present invention.
Figure 2:
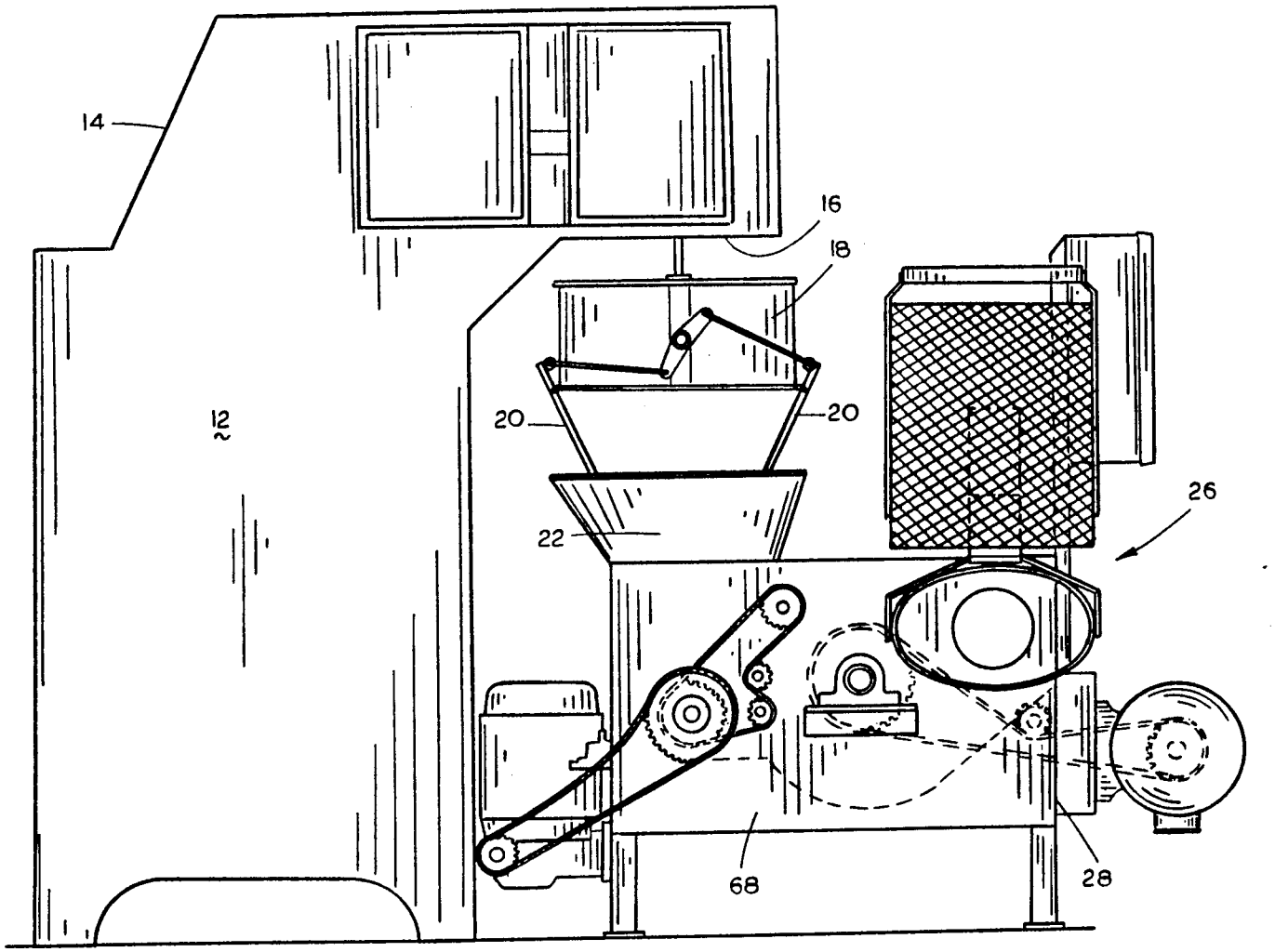
FIG. 2 is an elevational view of the pillow stuffing apparatus taken from the left side in FIG. 1.
Figure 3:
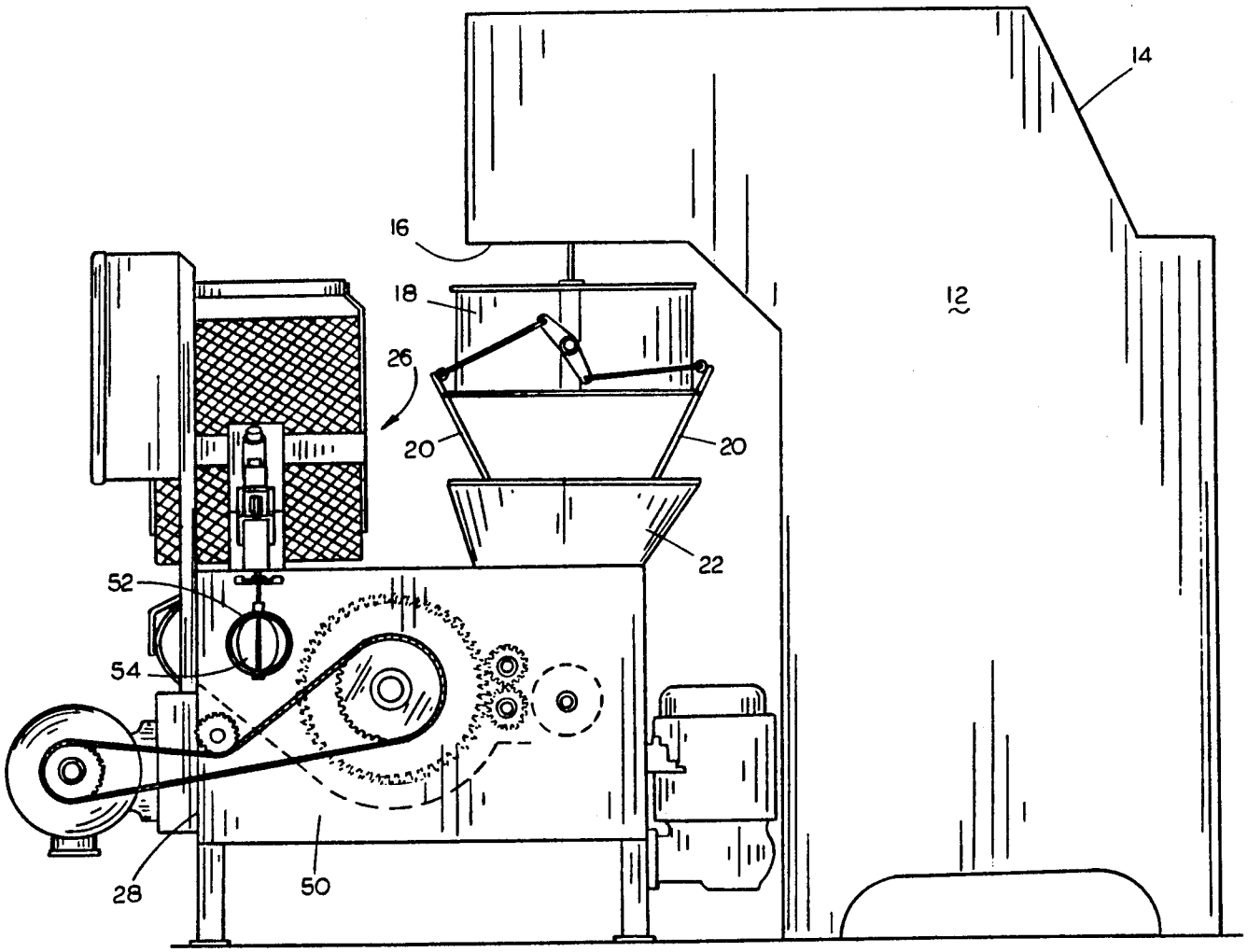
FIG. 3 is a side elevational view taken from the right side of FIG. 1.

Referring now to the drawings, in which identical or corresponding parts are identified with the same reference numeral, the pillow stuffing apparatus of the present invention is identified generally at 10 and is operably associated with a fiber processing device 12.

Fiber processor 12 receives polyester fiber material or the like from a bale through an opening 14 at the upper end of the unit. Processor 12 takes the highly compacted material from the bale and pulls the material apart for further processing. Once the polyester fiber material has been loosened, it is dropped from an outlet 16 into a container 18 having a pair of clamshell doors 20 in the bottom thereof. Container 18 is a scale, and is designed to operate doors 20 once a predetermined weight of the polyester fiber material has been accumulated therein. The fiber material is then dropped into an inlet chute 22 for processing by the pillow stuffing apparatus 10, which will also insert the fiber material within a tick 24 attached to an indexer 26.

Figure 4:
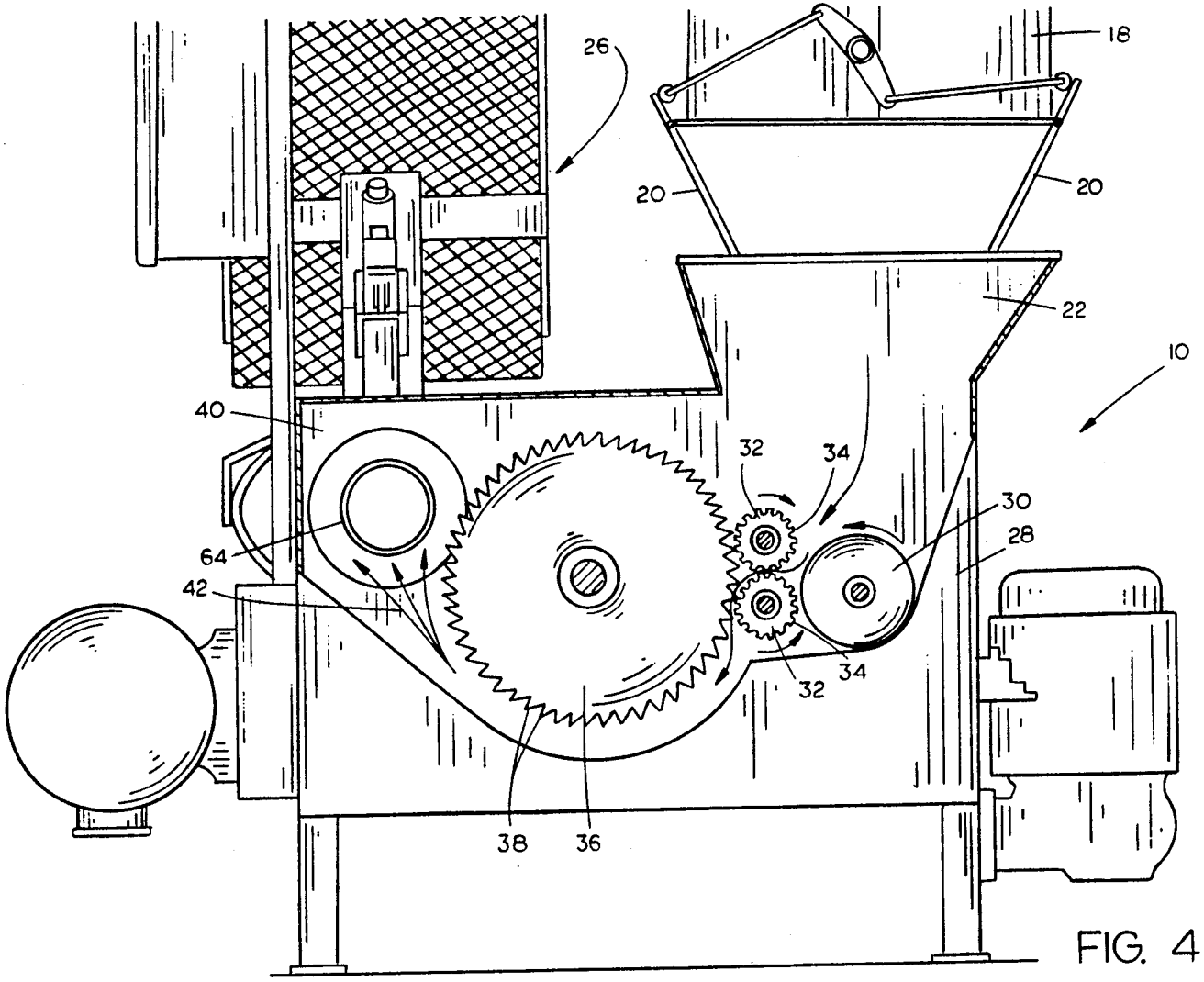
FIG. 4 is an enlarged cross-sectional view taken at lines 4—4 in FIG. 1.

Referring now to FIG. 4, pillow stuffing apparatus 10 includes a housing 28 having a roller 30 operably mounted therein. Fiber material which is dropped from container 18 into chute 22 will be directed by roller 30 between a pair of parallel generally cylindrical pinchers 32. Pinchers 32 have a plurality of longitudinal teeth 34, and are mounted such that teeth 34 of the two rollers pinch the fiber material therebetween as they rotate. In this way, polyester fiber is fed at a constant rate from roller 30.

A large fine-toothed roller 36 is mounted adjacent pinchers 32 and has a large number of teeth 38 which will grip and pull polyester fiber from pinchers 32. Roller 36 moves at a speed which will pull fibers from pinchers 32 faster than the material is delivered by the pinchers from roller 30. In this way, the fiber material is further loosened and fluffed. Roller 36 rotates at a speed which will also throw the fibers upward into an air stream created in an air chamber formed in the upper forward portion of housing 28, designated generally at 40. The path of the fibers is indicated generally by arrows 42, as the fibers leave roller 36.

An air current is produced in air chamber 40 of housing 28 by a fan unit 44 with its outlet 46 connected to an inlet portal 48 in the side wall 50 of housing 28 via duct 52. A valve 54 is interposed in duct 52 to allow for the mechanical shutoff of air from fan 44. Although valve 54 is shown with a handle 55, the valve could be automated. A tube 56, having a smaller diameter than duct 52, extends from inlet portal 48 substantially across the interior of housing 28. Air flow from fan 44 is bifurcated so as to pass within tube 56, as shown by arrow 58, and around the exterior of tube 56, as shown by arrows 60. Tube 56 is cantilevered within housing 28 with its upstream end 64 coaxially mounted partially within the end of duct 52, as shown in FIG. 1.

An outlet portal 66 is formed in side wall 68 opposite inlet portal 48, such that air flow from duct 52 passes out of housing 28 through a short duct 70. Indexer 26 is set up adjacent short duct 70 so as to align the open end of a tick 24 with short duct 70 to receive polyester fiber material.

In operation, polyester fiber material will be thrown from roller 36 into an air stream surrounding tube 56 and carried to outlet portal 66. Air flow then carries the fiber into tick 24 to uniformly fill the same without matting or compressing the fibers after leaving roller 36. Tick 24 extends within an open-mesh form 72, which will create the desired shape of the pillow as fiber is blown within the tick. Once a tick 24 is filled, valve 54 is closed to prevent additional fiber from being blown into the tick. An empty tick is mounted in a second open-mesh form 74, and the indexer 26 is operated to align the empty tick with short duct 70. The cycle is then repeated to fill the tick.

It should be noted that the preferred embodiment of the invention utilizes tube 56 so as to direct an air stream centered through short duct 70 and into tick 24. The invention will work without tube 56, however some swirling of the fiber material occurs within air chamber 40, and the fiber is not as efficiently inserted within tick 24. In any event, the stuffed tick will contain fluffy polyester fiber without the matting or compressed fibers which occur with fan units which are located so as to pull the fiber through the fan and thence to the tick.

Whereas the invention has been shown and described in connection with the preferred embodiments thereof, it will be understood that many modifications, substitutions and additions may be made which are within the intended broad scope of the appended claims. There has therefore been shown and described an improved pillow stuffing apparatus which accomplishes at least all of the above stated objectives.

I claim:

1. A pillow filling apparatus, comprising:

an enclosed housing having forward and rearward walls, opposite side walls, a top and a bottom, and an air chamber extending between the side walls;

an inlet chute in said housing for accepting pillow filling material;

operable means for loosening and fluffing said filling material, mounted within said housing;

an inlet portal in one side wall of said housing communicating with said air chamber in said housing; an outlet portal in the opposite side wall communicating with said air chamber and located directly opposite said inlet portal;

means connected to said inlet portal for creating an unobstructed air stream flowing downstream from said inlet portal through said air chamber and thence through said outlet portal, for carrying said fluffed fill material out through said outlet portal;

said operable means for loosening and fluffing including means for throwing the loosened and fluffed material into said air stream in said air chamber downstream of said means for creating the air stream; and means for removably connecting a tick to said outlet portal for filling with blown filling material.

2. The pillow filling apparatus of claim 1, wherein said means for creating an air stream includes a fan means connected to said inlet portal.

3. The pillow filling apparatus of claim 1, further comprising operable valve means interposed in said inlet portal for selectively opening or closing said inlet portal.

4. The pillow filling apparatus of claim 1, wherein said operable means for loosening and fluffing said filling material, includes:

a pair of pincher rollers operable to pull filling material at a constant speed; and a large roller operably mounted parallel to said pincher rollers and adjacent thereto, having a plurality of teeth projecting therefrom such that said teeth will loosen and pull fibers of said filling material from said pinchers upon rotation of said large roller.

5. The pillow filling apparatus of claim 4, wherein said large roller is operated at a speed great enough to throw said loosened fibers from said teeth into said air stream.

6. The pillow filling apparatus of claim 1, further comprising an elongated tube having an outside diameter less than the diameter of said inlet portal, so as to form an annular space between said tube and said portal, mounted within said air chamber coaxial with said inlet and outlet portals, said tube extending from said inlet portal less than the entire distance between the side walls, such that air from said inlet portal is bifurcated so as to flow both through the interior of said tube and around the exterior circumference of said tube to said outlet portal.

7. The pillow filling apparatus of claim 6, wherein said tube is of a length such that fibers carried by said air stream are directed out through said outlet portal.

8. A method for filling a pillow tick with filling material, comprising the steps of:

providing a source of filling material and an apparatus for loosening and fluffing the filling material;

operating said loosening and fluffing apparatus so as to produce fluffed material;

providing means for creating an air current which flows from said fluffing apparatus into an open pillow tick; and throwing said fluffed material from said fluffing apparatus into said air current downstream of the means for creating the air current, to be carried unobstructed to said pillow tick.

9. The pillow filling apparatus of claim 1, wherein said inlet and outlet portals are spaced above the housing bottom, and adjacent to the top thereof, such that material is carried out of the outlet portal without contacting the housing bottom.

10. The pillow filling apparatus of claim 9, wherein said means for throwing the loosened and fluffed material into said air stream includes a large roller operably mounted in said housing having a plurality of teeth projecting therefrom and rotatable at a speed great enough to throw the loosened and fluffed material upwardly into said air stream.

* * * * *